United States Patent [19]

Creutz et al.

[11] Patent Number: 4,714,195

[45] Date of Patent: Dec. 22, 1987

[54] TRACK SPIKE WITH A SINGLE OR DOUBLE SHAFT

[75] Inventors: Walter Creutz, Dortmund; Peter Dahlhaus, Radevordmwald; Heinz Hofmann, Dortmund, all of Fed. Rep. of Germany

[73] Assignee: Hoesch Aktiengesellschaft, Fed. Rep. of Germany

[21] Appl. No.: 774,539

[22] Filed: Sep. 10, 1985

[30] Foreign Application Priority Data

Oct. 16, 1984 [DE] Fed. Rep. of Germany ..... 3437839

[51] Int. Cl.[4] ..... E01B 9/08

[52] U.S. Cl. ..... 238/349; 238/366

[58] Field of Search ..... 238/349, 366, 371

[56] References Cited

U.S. PATENT DOCUMENTS

| | | | |
|---|---|---|---|
| 2,150,259 | 3/1939 | Woodings | 238/366 X |
| 2,215,593 | 9/1940 | Packer | 238/366 X |
| 2,929,561 | 3/1960 | Jack | 238/366 |
| 4,339,077 | 7/1982 | Dahlhaus et al. | 238/349 |

FOREIGN PATENT DOCUMENTS

| | | | |
|---|---|---|---|
| 197110 | 7/1965 | Sweden | 238/366 |
| 779534 | 7/1957 | United Kingdom | 238/366 |
| 1011199 | 11/1965 | United Kingdom | 238/366 |
| 1032726 | 6/1966 | United Kingdom | 238/349 |

*Primary Examiner*—Randolph A. Reese

*Attorney, Agent, or Firm*—McCormick, Paulding & Huber

[57] ABSTRACT

A track spike (1) with a single or double shaft for wooden ties with spring loop (6), shaft (5) and crosspiece (4). The crosspiece (4), is, in its upper area via a bend (9) of the corresponding shaft portion in the direction of the rail foot (8), offset with resilience relative to the shaft (5). The crosspiece thus engages and retains the rail in position on the tie.

2 Claims, 4 Drawing Figures

TRACK SPIKE WITH A SINGLE OR DOUBLE SHAFT

The invention relates to a track spike with a single or a double shaft for wooden ties with spring loop, shaft and crosspiece.

These track spikes are put in position to fix rails resiliently onto wooden ties. It is the purpose of the crosspiece to limit the depth of insertion of the spring nail and to prevent a lateral moving out of the rail at the rail foot. The shaft of the track spike is hammered into corresponding bores in the tie. The track spike holds the rail down at the rail foot with its spring loops.

Such a track spike for wooden ties is known from DE-PS No. 1 106 788. A shortcoming of this spring spike for wooden ties is the need for providing a distance between the rail foot and the crosspiece of the track spike because of variations in rail manufacturing and the bore variations in the ties. This distance affects the torsional resistance of the tie negatively.

It is therefore an object of the invention to provide a track spike which in case of different widths of the rail foot improves the torsional resistance of the rail on the tie in accordance with the required allowable variations.

According to the invention this object is attained by forming the crosspiece via a bend of the corresponding shaft portion in its upper area in direction of the railfoot, offset with resilience relative to the shaft. Further advantageous features of the invention are described in the characterizing portion of the dependent claim.

According to the DE-AS No. 1 241 857 it is known to provide a resilient wave-shaped or bent shaft of track spikes for concrete ties. The purpose is to increase the resistance to pull-out from the tie to the extent necessary, since upon the use of spring nails in concrete there is no locking between the shaft of the track spike and the material of the tie, as is the case by squeezing the wood in wooden ties. Due to the different problems in using spring nails in concrete or wood, the teaching of this patent application is not suitable for solving the problem of the present invention. The different effects in using spring nails in either concrete or wood are already obvious due to the fact that in case of concrete the bore must be larger than the cross-section of the shaft when folded together. In case of wood, the cross-section of the bore is smaller than the cross-section of the shaft when folded together. The embodiment of wave-shaped or bent shafts according to DE-AS No. 1 241 857 would not make any difference with respect to the track spike according to DE-PS No. 1106 788 after hammering it into the bore of a wooden tie, since after hammering it in, the halves of the shaft would be adjacent. Only by providing a track spike according to the invention with a bend only in the upper part of the corresponding shaft portion, the technical advance with the results as described below becomes possible.

The advantages attained under the present invention reside particularly in the fact that a track spike for wooden ties is suitable to take care of the variations in the width of the rail foot, thus improving the torsional resistance between rail and tie. Moreover, the slide resistance of the rail on the tie is enhanced since the rail is not only held down, but is also laterally, elastically braced at the rail foot. A further result is that small variations in the bore cross-section for the shaft of the track spike do not affect the pull-out resistance of the spring nail very much.

Embodiments of the invention are shown in the drawings and are described below in detail.

Figure 2:
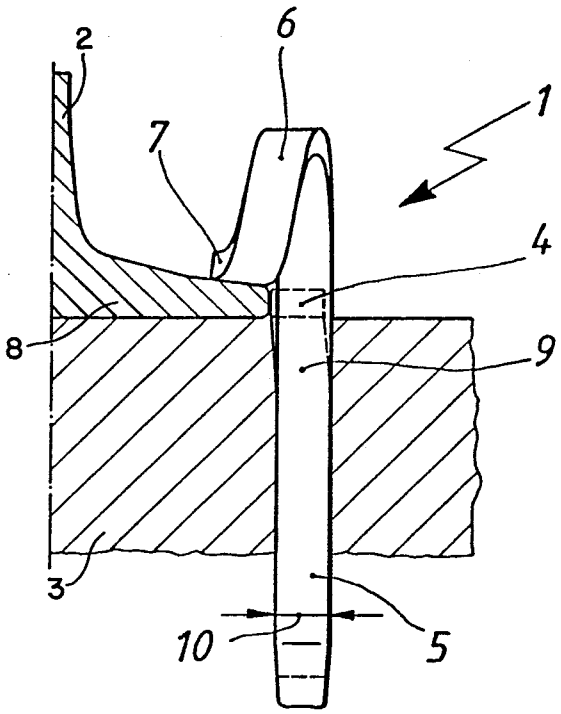
FIG. 2 is a section through the rail in lateral direction and a longitudinal section through the tie with side elevation of the track spike having a single shaft according to FIG. 1.
Figure 1:
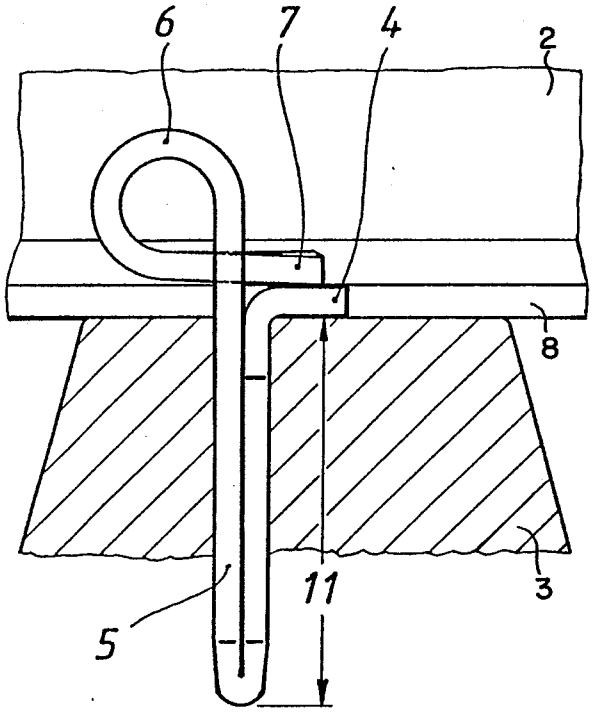
FIG. 1 is a section through a tie in the longitudinal direction of the rails with a view of a track spike having a single shaft, and of a portion of a rail.

As FIGS. 1 to 4 show, it is the purpose of the resilient track spike 1 to hold the rail 2 resiliently down on the tie 3. For this purpose, the track spike 1 has been bent from a spring band. It consists of a crosspiece 4, a shaft 5 and a spring loop 6. The track spike 1 with a single shaft as shown in FIGS. 1 and 2 has a shaft 5 which is formed of a spring strip, bent together at the shaft tip, and ends at one end in a crosspiece 4 and at the other end in a spring loop 6. The spring loop 6 presses down the foot 8 of the rail 2 with its free end 7.

Figure 4:
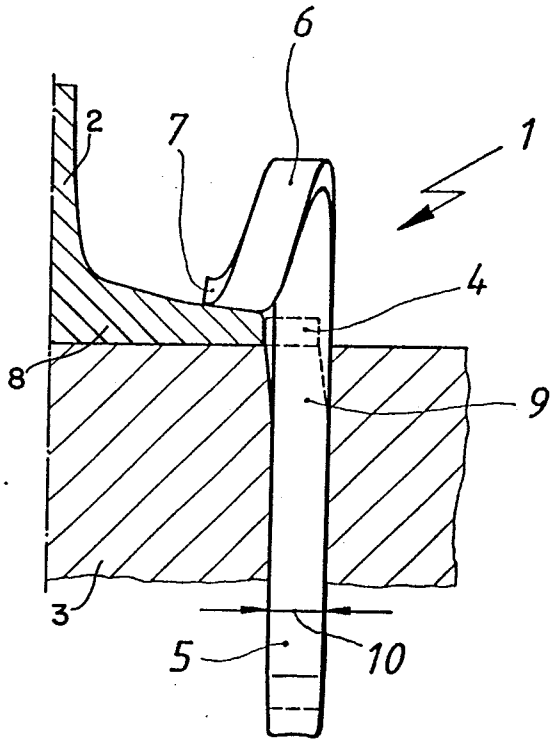
FIG. 4 is a section through the rail in lateral direction with the track spike having a double shaft according to FIG. 3.
Figure 3:
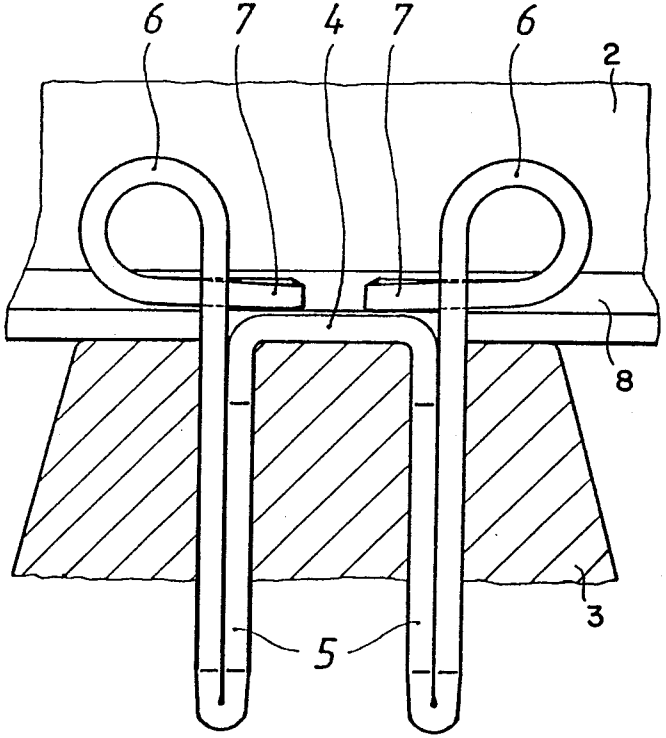
FIG. 3 is a section according to FIG. 1 with a track spike having a double shaft.

The track spike 1 with a double shaft as shown in FIG. 3 and 4 has two shafts 5 which are interconnected by a continuous crosspiece 4 and end in a spring loop 6 each. In the track spike 1 according to the invention, the shaft portion which is connected with the crosspiece 4 is formed in its upper part with a bend 9 in the direction of the rail foot. The bend 9 is in the unbraced state of the track spike 1 formed in a position, offset at most by one third of the total shaft thickness 10. It extends at most over one fourth of the total shaft length 11.

We claim:

1. A track spike for wood ties having resiliently spaced double shaft portions each with a spring loop and a crosspiece therebetween, each double shaft portion being over relative to a corresponding bore in a wood tie, characterized in that the crosspiece carrying shaft portions are offset resiliently over at most one quarter of their length via a bend of the upper part thereof in a direction toward the corresponding rail foot, the crosspiece thus being maintained in pressure engagement with the corresponding rail foot despite squeezing of the shaft portions together during insertion into their respective bores.

2. Track spike according to claim 1, characterized in that the crosspiece (4) is formed in such a way that it is in its unbraced position offset at most by one third of the total shaft thickness (10).

* * * * *